US008128288B2

(12) United States Patent
Feeney

(10) Patent No.: US 8,128,288 B2
(45) Date of Patent: Mar. 6, 2012

(54) ADAPTABLE GIFT BAG

(76) Inventor: Stacey A. Feeney, Monroeville, PA (US)

( * ) Notice: Subject to any disclaimer, the term of this patent is extended or adjusted under 35 U.S.C. 154(b) by 1071 days.

(21) Appl. No.: 11/957,745

(22) Filed: Dec. 17, 2007

(65) Prior Publication Data

US 2008/0152265 A1 Jun. 26, 2008

Related U.S. Application Data

(60) Provisional application No. 60/876,080, filed on Dec. 20, 2006.

(51) Int. Cl.

| | |
|---|---|
| ***B65D 30/02*** | (2006.01) |
| ***B65D 33/00*** | (2006.01) |
| ***B65D 30/00*** | (2006.01) |
| ***B65D 30/08*** | (2006.01) |
| ***B65D 30/10*** | (2006.01) |
| ***B65D 65/38*** | (2006.01) |

(52) U.S. Cl. ..... 383/118; 383/97; 383/107; 383/109; 383/121; 229/87.19

(58) Field of Classification Search ..... 383/118, 383/41, 97, 107, 66, 109, 121; 229/87.18, 229/87.19

See application file for complete search history.

(56) References Cited

U.S. PATENT DOCUMENTS

| | | | | |
|---|---|---|---|---|
| D296,870 | S | | 7/1988 | Myers |
| D350,475 | S | | 9/1994 | Cirelli |
| 5,374,232 | A | | 12/1994 | Cipollone |
| 5,392,983 | A | * | 2/1995 | Clarke-Bolling et al. . 229/87.19 |
| 5,456,062 | A | | 10/1995 | Wechsler |
| 5,518,313 | A | | 5/1996 | McAdam |
| 5,683,769 | A | | 11/1997 | Cheng |
| 5,743,458 | A | | 4/1998 | French |
| D417,143 | S | | 11/1999 | Irvine |
| 5,979,744 | A | * | 11/1999 | Brigleb ..... 229/87.01 |
| 6,068,401 | A | * | 5/2000 | Ho ..... 383/97 |
| 6,092,932 | A | | 7/2000 | Pekala |
| D441,278 | S | | 5/2001 | Remar |
| D441,279 | S | | 5/2001 | Remar |
| 6,241,389 | B1 | | 6/2001 | Gilmore et al. |
| 2003/0128897 | A1 | | 7/2003 | Lehrman |
| 2005/0161352 | A1 | * | 7/2005 | Huddleston ..... 206/320 |
| 2005/0201642 | A1 | * | 9/2005 | Terry ..... 383/41 |
| 2007/0041670 | A1 | * | 2/2007 | Spizman et al. ..... 383/118 |
| 2008/0047078 | A1 | * | 2/2008 | Gully ..... 8/158 |

* cited by examiner

*Primary Examiner* — Jes F Pascua
(74) *Attorney, Agent, or Firm* — Polly L. Oliver

(57) ABSTRACT

The Adaptable Gift Bag is a bag made of relatively opaque, stretchy material, not paper or netting, so that it can fit over various sizes and shapes of gift items and present a smooth, attractive appearance. The Adaptable Gift Bag is typically made of a single sheet of material folded over and sewn along one or two sides so that it has one open end, but in alternate embodiments it could have two open ends. The open end can be closed around the gift by gathering and tying with traditional ribbon or cord, by attaching a drawstring, or alternatively can be twisted and stretched back over the gift for a unique finished appearance. The Adaptable Gift Bag may be lined (e.g., with a different material), may include a zipper for easier removal from the gift item, and/or may include strategically placed elastic bands in its interior for a better fit (esp. at the corners). Using a shimmery, sparkly, or iridescent material provides a festive appearance for the finished gift.

13 Claims, 5 Drawing Sheets

ADAPTABLE GIFT BAG

RELATED APPLICATIONS

This application is related to and claims priority under 35 U.S.C. 119(e) to U.S. Provisional application Ser. No. 60/876,080, entitled "Adaptable Gift Bag," filed on Dec. 20, 2006, with inventor Stacey Feeney, which is hereby incorporated by reference in its entirety.

FIELD OF THE INVENTION

This invention pertains generally to bags for articles and more specifically to a reusable gift bag that can adapt to various sizes and shapes of boxed or non-boxed gift items.

BACKGROUND OF THE FIELD

Traditional gift wrapping material is provided in flat sheets of paper that the gift-giver must then measure, cut, wrap around the gift item, and tape into position. The gift-giver may then finish the gift with ribbon. Not only does this operation require time and effort and generate trash (excess paper, tape, and ribbon), but the gift recipient typically generates more trash when he/she unwraps the gift and throws away the paper and ribbon that was used.

More recently, paper gift bags have been provided for gift-givers to use—eliminating the paper waste and reducing the time and effort for the gift-giver to prepare the gift. For the sake of this simplicity, "fit" has been sacrificed. Because gift bags do not fit each gift's particular size and shape, gift-givers often use several sheets of tissue paper to "wrap" the gift and/or fill up the paper bag.

There have been some prior efforts to address these problems. Specifically, U.S. Pat. No. 5,456,062 to Wechsler discloses a gift bag made from stretchable material that fits various shapes and sizes of gifts. However, Wechsler's material is a see-thru hosiery netting (and is consistently described as such throughout the entire document, including the claims), not an opaque material as is the Applicant's, and so cannot conceal the gift completely—allowing for a much narrower range of application. (Applicant's stretchy materials have a much tighter weave than netting and so offer complete concealment.) In addition, Wechsler's material does not lend itself to being finished as in the Applicant's methods—by tying bows or knots with the material itself. (Wechsler uses a ribbon or drawstring.) Also, the Applicant has identified and solved a problem that Wechsler does not address—that of the bottom corners. (Wechsler conveniently does not show the corners in her drawing figures.)

Other efforts, such as in U.S. Pat. No. 6,092,932 to Pekala et al. and U.S. Pat. No. 6,241,389 to Gilmore et al. simply disclose loose gift bags made of fabric rather than paper but which, because they are not stretchy, do not conform to the gift item's shape or offer the finishing treatments of Applicant's bag.

U.S. Pat. No. 5,743,458 to French discloses a gift wrapping made of a stretchy material, but the wrapping is not intended to cover—and does not cover—the entire gift item. French's wrapping is applied to the gift item in a different way, using elastic straps to hold the wrapping on only a part of the gift item. Even French's alternate embodiment of a sleeve of material is limited in its application. Because French wraps only cylindrical bottles, once again, she does not address the problem of corners, and does not offer finishing treatments as does Applicant.

SUMMARY OF THE INVENTION

The present invention solves the above-mentioned problems by providing a gift bag that can adapt to a gift item's shape—whether it is regular like a rectangle or cylinder or irregular like lumpy shape. The adaptable gift bag is made from a stretchy material which may be a single piece or two or more pieces fastened together (perhaps by sewing). Using a shimmery, sparkly, or iridescent material often gives a festive external appearance. A variety of finishing treatments may be applied to create unique finished gifts for any occasion, and they may be further personalized to the giver and/or the recipient with additional external decorations.

One embodiment of the invention comprises a generally rectangular piece of an opaque stretchy material having two opposing edges that are sewn together to make a seam—creating a bag shape—the gift bag. A gift item is then inserted into the bag so that it is completely concealed therein, leaving one or two tail ends extending beyond the gift item, and the tail ends are closed with any one (or more) of the various finishing treatments herein disclosed or otherwise developed. There are different possible finishing treatments for single-tail and double-tail bag configurations. Further possibilities are made available with the used of patterned, textured, or lined materials.

BRIEF DESCRIPTION OF THE DRAWINGS

The objects, features, and advantages of the present invention will be apparent to one skilled in the art from reading the following description in which.

DETAILED DESCRIPTION

The following specification describes an adaptable gift bag. In the description, specific materials and configurations are set forth in order to provide a more complete understanding of the present invention. But it is understood by those skilled in the art that the present invention can be practiced without those specific details. In some instances, well-known elements are not described precisely so as not to obscure the invention.

Figure 1A:
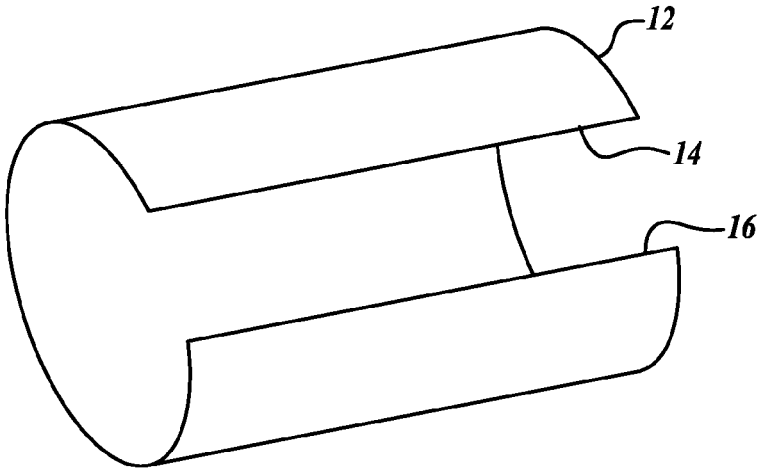
FIG. 1A is a perspective view of a piece of stretchy material generally presented as a rectangular flat pattern.

FIG. 1A simply shows a piece of opaque stretchy material 12 (not netting) in a generally rectangular flat pattern having two opposing edges 14 and 16. Stretchy material has been chosen for this invention because it can adapt to different shapes of gifts—e.g., regularly shaped boxes in rectangles and cylinders or other irregular, even lumpy shapes. Stretchy material of relatively tight and close weave, as opposed to netting, has been chosen to offer an opaque material that completely conceals the gift item inside. Likewise a rectangular flat pattern has been chosen for the cut material as an optimum shape for forming the bag; however, the invention could be practiced with other shapes—e.g., circles, squares, irregular shapes, etc. It will be seen in further discussion how different materials, i.e., with patterns and textures, can give different looks, appearances, and effects to the overall finished gift. The user has a wide variety of choices to create the perfect, unique gift for the occasion.

Figure 1B:
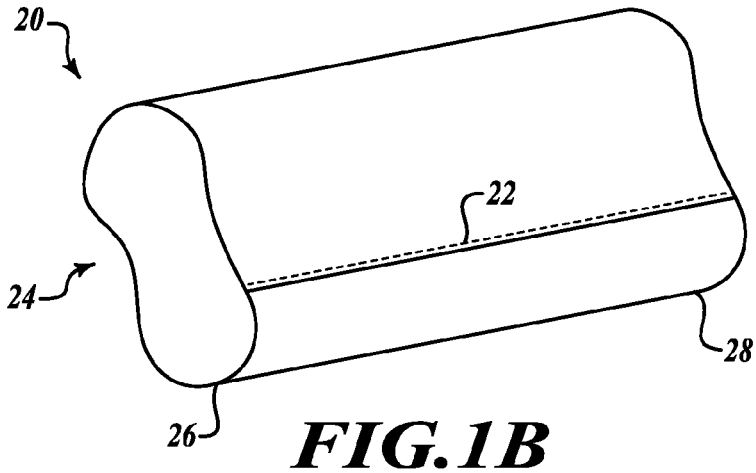
FIG. 1B is a perspective view of a first embodiment of a bag shape with two open ends—"double-tail" (bag shape is created by sewing along opposing edges)
Figure 1C:
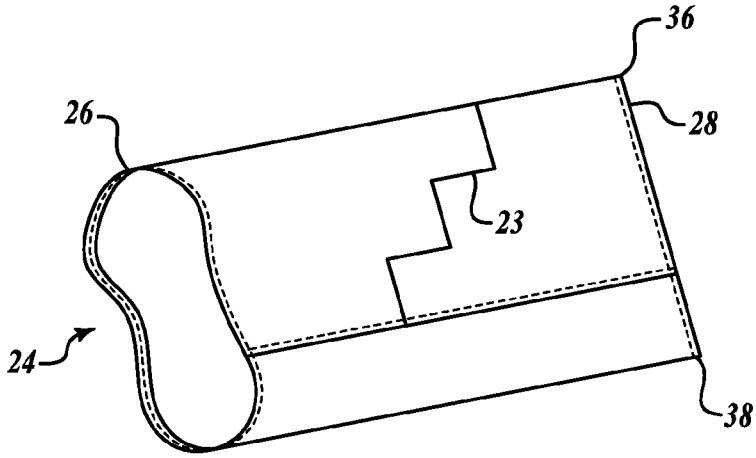
FIG. 1C is a perspective view of a second embodiment of a bag shape with one open end and one closed end—"single-tail" (open end has finished edges)

FIG. 1B shows how the two opposing edges 14 and 16 are sewn together (or otherwise fastened together with adhesive, hook-and-loop fasteners, taping, etc.) to form a bag 20 having a single seam 22 and an interior 24. At this stage, the bag 20 is said to have two tails 26 and 28. Both tails can be left open as shown in FIG. 1B, or one tail end could be closed—e.g., with sewing—as shown in FIG. 1C, where the tail end 28 has been closed by sewing. (At least one tail must be left open for insertion of the gift item.) Closing the tail 28 offers a broader range of gifting options and finishing treatments. If only one end, e.g. 26, extends beyond the inserted gift item, then the gift bag is said to be in a single-tail configuration; if both ends extend beyond the inserted gift item, then the gift bag is said to be in a double-tail configuration. Different finishing treatments are available for single-tail and double-tail bags; however, even if one tail of the bag is closed, that bag can still be used as a double-tail bag as far as the finishing treatment used, simply by inserting the gift item midway down the bag instead of all the way to the closed end.

Figure 2:
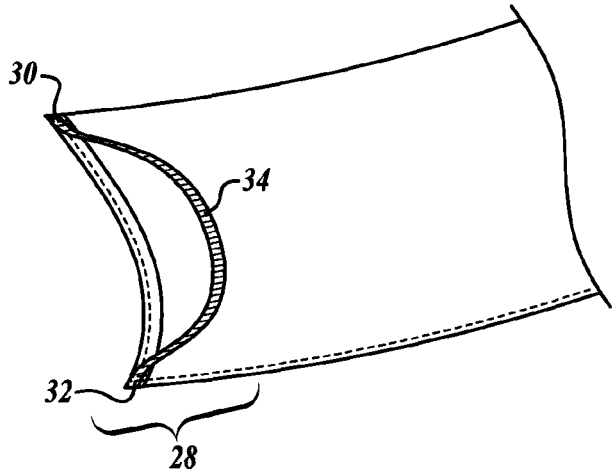
FIG. 2 is a detail view of the inside of a "single-tail" gift bag showing the elastic between the interior corners of the closed end.

Closing the tail end 28 will form outside corners 36 and 38 which correspond to inside corners 30 and 32 as shown in FIG. 2. If the tail 28 is closed, then it is recommended that the inside corners 30 and 32 be connected to each other with a piece of elastic 34 in the interior 24 of the bag. The elastic may or may not be under tension as it is applied to the empty bag, but it is usually not. It will usually be stretched and therefore put under tension as the bag is filled with a gift item 40. The elastic serves to smooth out the outer appearance of the bag around the gift item. The outer corners 36 and 38 can further be tucked into the bag to enhance the smooth and snug outer appearance of the bag as it fits around the gift item 40. Alternatively, the piece of elastic 34 could be applied to the exterior corners of the bag instead of the interior corners. Depending upon the materials chosen and the overall design goals, this option may provide an aesthetic and desirable "look." Another alternative option is to use two or more stretchy materials—perhaps of different but complimentary patterns or textures—to be sewn or otherwise fastened together. This will create a unique look, and it may be designed so that the secondary seam 23 will be a part of the design (as shown in FIG. 1C).

Figure 3A:
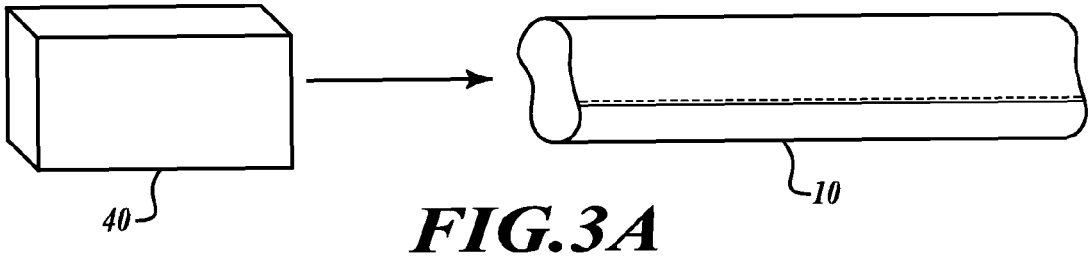
FIG. 3A is an exploded perspective view of a gift item to be inserted into a double-tail gift bag.
Figure 3B:
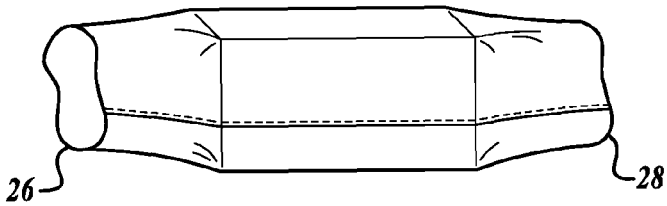
FIG. 3B is a perspective view of the double-tail gift bag with item inserted.
Figure 3C:
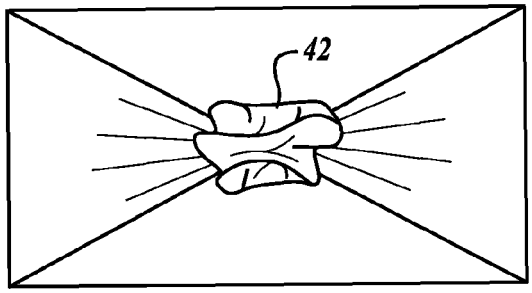
FIG. 3C is a top view showing how the tail ends may be tied in a knot.

FIG. 3A shows a gift item 40 as it is to be inserted into an adaptable gift bag 10, here an opaque bag with two open ends. FIG. 3B shows the bag 10 after the gift item has been inserted into the approximate middle of the bag, and the tail ends extend beyond the gift item. As previously discussed, a double-tail bag configuration can have one closed end, and the closed end will just be treated as any other tail. Regardless of the shape of the gift item (regular or irregular), the gift item will define two opposing sides adjacent the tail ends. Upon insertion of the gift item into the bag, the bag material is fitted as desired around the gift item to completely conceal the gift and to smooth its appearance or locate the external pattern. FIG. 3C shows one option for a finishing treatment: the two tail ends—the first end 24 and the second end 26—can be gathered and tied together in a knot 42 over the gift item to create a pleasing outer appearance. The stretchy quality of the material used allows that the finished gift will look smooth and attractive. Alternatively to the knot, the two tail ends could be twisted together and tied with a ribbon or other cordage.

Figure 4A:
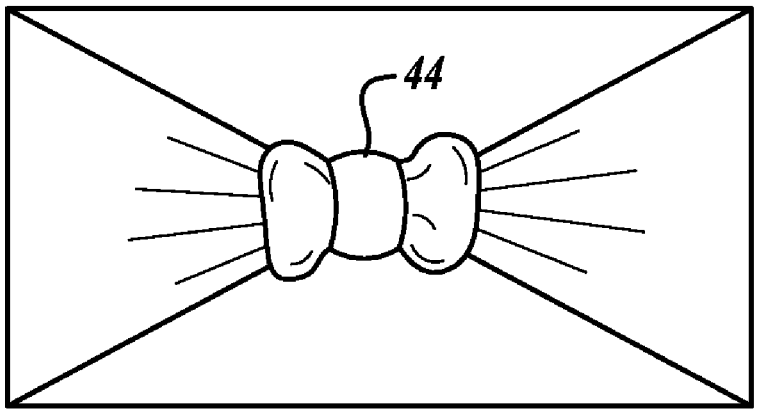
FIG. 4A is a top view of a double-tail gift bag with tail ends tied in a bow.
Figure 4B:
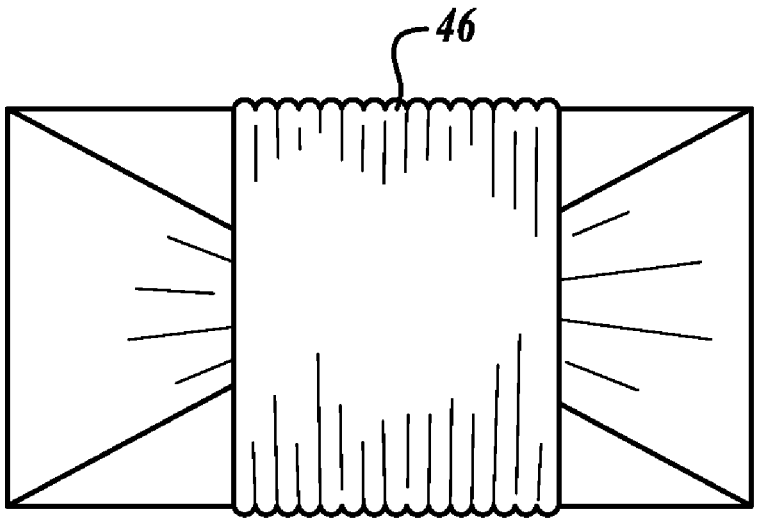
FIG. 4B is a top view of a double-tail gift bag with material shirred over the gift item and the tail ends tucked under the shirring.

FIGS. 4A and 4B illustrate alternative options for finishing treatments. In FIG. 4A, the two tail ends have been gathered and tied over the gift item into a bow 44. Obviously, pushing the gift item 40 further into the bag 10, instead of centering it, will make the tails different lengths and offer different looks to the finish—whether it is a knot, a bow, tied with ribbon, or something else. FIG. 4B shows an option wherein the bag material has first been shirred over the gift item (during the fitting step) before leaving and extending the two tails. The two tails can then be tucked under the shirring 46 to create a candy-type appearance.

Figure 5A:
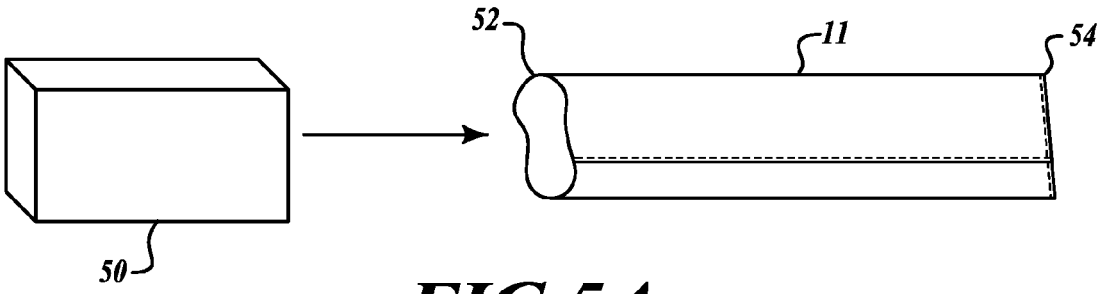
FIG. 5A is an exploded perspective view of a gift item to be inserted into a single-tail gift bag.
Figure 5B:
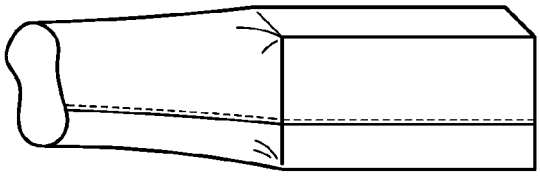
FIG. 5B is a perspective view of a single-tail gift bag with item inserted.
Figure 5C:
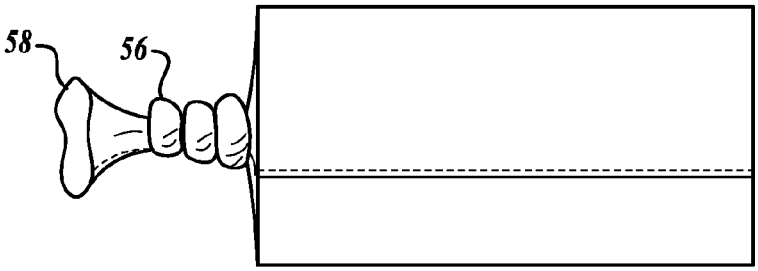
FIG. 5C is a side view showing how tail end may be twisted.

FIGS. 5A-C illustrate the alternative method of using a single-tail gift bag 11. In this method, the tail 54 of the bag must be closed so that the gift item 50 can be inserted and pushed all the way into the bag to rest against the closed end 54. FIG. 5A shows how the gift item 50 will be inserted through the open tail end 52. FIG. 5B shows how the stretch of the relatively closely-woven material allows the gift item 50—which may be of a different shape instead of rectangular—to be completely inserted into and concealed within the bag leaving a single tail end extending beyond the gift item. Upon insertion of the gift item into the bag, the bag material is fitted as desired around the gift item to smooth its appearance or locate the external pattern, and the gift item and/or the gift bag may then be adjusted as necessary to smooth out the corners at the closed end 54, using the elastic therebetween. FIG. 5C shows one possibility for a finishing treatment of the tail end 52. The tail end 52 can be gathered and twisted or tied in a knot 56 on top of the gift item.

Figure 6A:
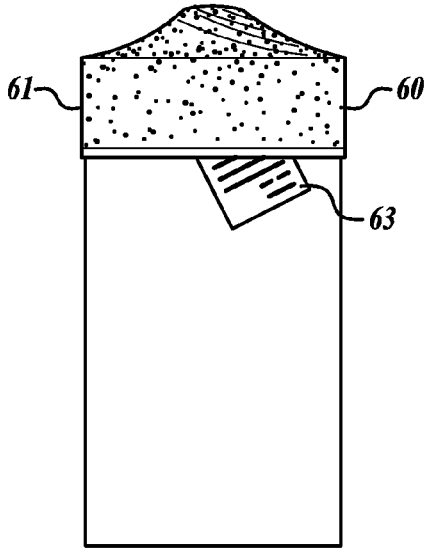
FIG. 6A is a side view of a single-tail gift bag with tail end twisted and folded back over the item defining a pocket.
Figure 6B:
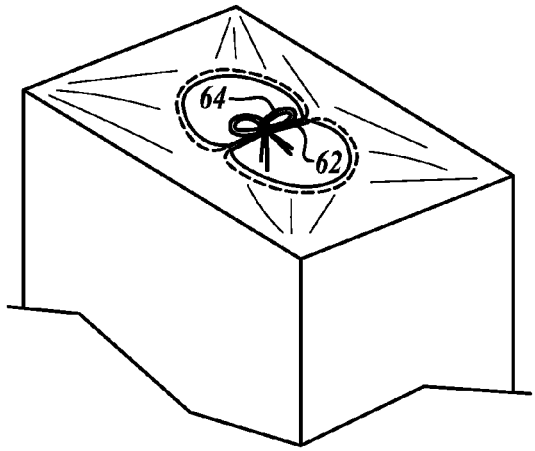
FIG. 6B is a perspective view of a single-tail gift bag with tail end gathered with a drawstring.
Figure 6C:
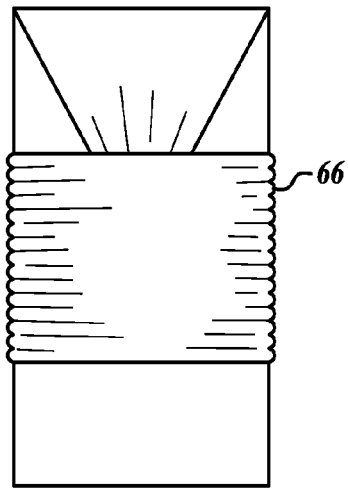
FIG. 6C is a side view of a single-tail gift bag with material shirred over the gift item and the tail end tucked under the shirring.
Figure 6D:
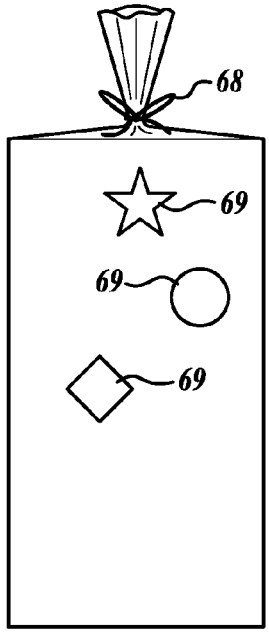
FIG. 6D is a side view of a single-tail gift bag showing how the tail end may be gathered into a neck and tied with a ribbon and also showing additional decorations.

Alternatively, if the tail end is twisted, the free edges 58 of the tail may be folded back over the gift item to create a unique look as shown in FIG. 6A. This look may be described as a "hat" or cap 60 on the gift. For this embodiment, a liner 61 may enhance the gift's outer appearance. (If the stretchy material is lined, the liner material is typically chosen to be complimentary and may line the stretchy material only partially.) Moreover, the cap 60 defines a convenient pocket for a gift card or tag 63 to be held in place on the exterior of the gift. In FIG. 6B, the free edges 58 of the tail have a drawstring 62 that can be gathered and tied in a knot or bow 64. FIG. 6C shows how the shirring method can work with a single-tail bag. During the fitting of the bag over the gift item, the material is shirred over the gift item and then the tail end 52 is gathered and tucked under the shirring 66. In FIG. 6D, the tail end 52 is simply gathered to form a "neck" and tied with a ribbon 68. Additional decorations 69, such as stickers, tags, etc., can be added to the exterior of the bag by attaching to the material. In this way, the gift can be further tailored to the occasion and/or personalized to the giver and recipient.

Figure 7:
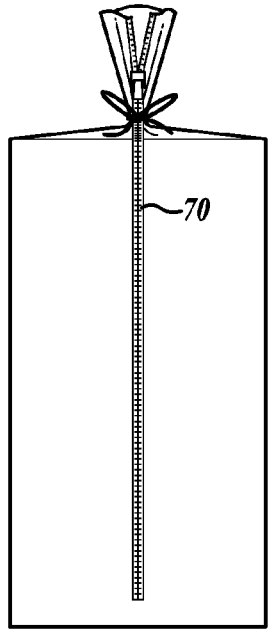
FIG. 7 is a side view of a gift bag with zipper included.

FIG. 7 shows a finishing treatment similar to the previous figure, where the tail end has been gathered and tied with a ribbon; however, a zipper 70 has been added to the material. Adding a zipper 70 not only presents a different unique outer appearance, but also allows for a broader range of materials to be used to construct the adaptable gift bag. Because the zipper can facilitate insertion and removal of the gift item, it is not necessary that the material be as stretchy as in prior embodiments. A material with stretch characteristics is still suggested to give the overall gift the smooth appearance, but materials such as fleece and felt may be used here.

What is claimed is:

1. An adaptable gift bag comprising a piece of opaque stretchy material having two opposing edges, at least one seam connecting said two opposing edges forming a bag having an interior for completely inserting a gift item therein and an exterior, wherein said bag is closed at one end and is open at the opposing, tail end, and wherein corners are formed upon the closing of said closed end and said corners are attached to each other with a piece of elastic in the interior of said bag, and wherein said tail end of said bag extends beyond said gift item to completely conceal said gift item, and is finished by a finishing treatment.

2. The adaptable gift bag of claim 1 wherein said piece of stretchy material is lined at least partially on one side with a liner material.

3. The adaptable gift bag of claim 1 wherein said piece of stretchy material is made from two or more pieces of stretchy material fastened together.

4. The adaptable gift bag of claim 1 wherein said closed end of said bag is closed by sewing.

5. The adaptable gift bag of claim 1 wherein said corners are further tucked into the bag to give a smooth appearance.

6. The adaptable gift bag of claim 1 further comprising additional decorations being attached to said exterior of said bag.

7. The adaptable gift bag of claim 1 further comprising a zipper.

8. A method of wrapping a gift item with an adaptable gift bag wherein said adaptable gift bag comprises a single-tail bag with one closed end made from a closely-woven stretchy material, said bag having an interior and an exterior, wherein corners are formed upon the closing of said closed end and said corners are attached to each other with a piece of elastic in the interior of said bag, comprising the steps of: inserting a gift item into said bag until said gift item rests against said closed end forming corners and is completely concealed; fitting said bag over said gift item leaving a tail end of said bag extending beyond said gift item; adjusting said gift item as necessary to smooth out said corners; and finishing said tail end of said bag with a finishing treatment.

9. The method of claim 8 wherein said finishing treatment comprises gathering said tail end; twisting said tail end; and folding said tail end back over said gift item to create a cap.

10. The method of claim 9 further comprising the step of inserting a gift card into a pocket defined by said cap on the exterior of the bag.

11. The method of claim 8 wherein said finishing treatment comprises gathering said tail end to form a neck and tying a ribbon around said neck.

12. The method of claim 8. wherein said finishing treatment comprises finishing said tail end with a drawstring.

13. The method of claim 8 wherein said fitting step further comprises shirring said material around said gift item and said finishing treatment includes gathering said tail end and tucking it under said shirring.

* * * * *